US005618251A

United States Patent [19]

Sullivan

[11] Patent Number: 5,618,251

[45] Date of Patent: Apr. 8, 1997

[54] HIGH INTENSITY EXERCISE SYSTEM

[76] Inventor: Phillip A. Sullivan, 284 W. Gail Ave., Tulare, Calif. 93274

[21] Appl. No.: 658,150

[22] Filed: Jun. 4, 1996

[51] Int. Cl.[6] ..... A63B 22/14; A63G 1/12

[52] U.S. Cl. ..... 482/146; 472/14; 472/18

[58] Field of Search ..... 472/14, 18, 135; 482/146, 147

[56] References Cited

U.S. PATENT DOCUMENTS

| | | | |
|---|---|---|---|
| 2,920,889 | 1/1960 | Keeling | 472/14 |
| 2,949,298 | 8/1960 | Speelman | 472/135 |
| 3,268,223 | 3/1964 | Woodsum | 472/14 |
| 3,885,788 | 5/1975 | Harris | 472/135 |

*Primary Examiner*—Richard J. Apley
*Assistant Examiner*—William LaMarca
*Attorney, Agent, or Firm*—Dennis B. Haase

[57] ABSTRACT

The present invention relates to a device for performing high intensity exercises wherein the user sits in and is encircled in a padded chair mounted at an acute angle on a base member and, further, having a padded area encircling the thigh and knee area of the user, the chair being free to rotate relative to the base member and wherein the user applies pressure to various parts of the chair to limit rotation while the user performs his or her exercise routine, with a resultant high intensity workout for all of the users major muscle groups, in addition to obtaining an aerobic result.

20 Claims, 3 Drawing Sheets

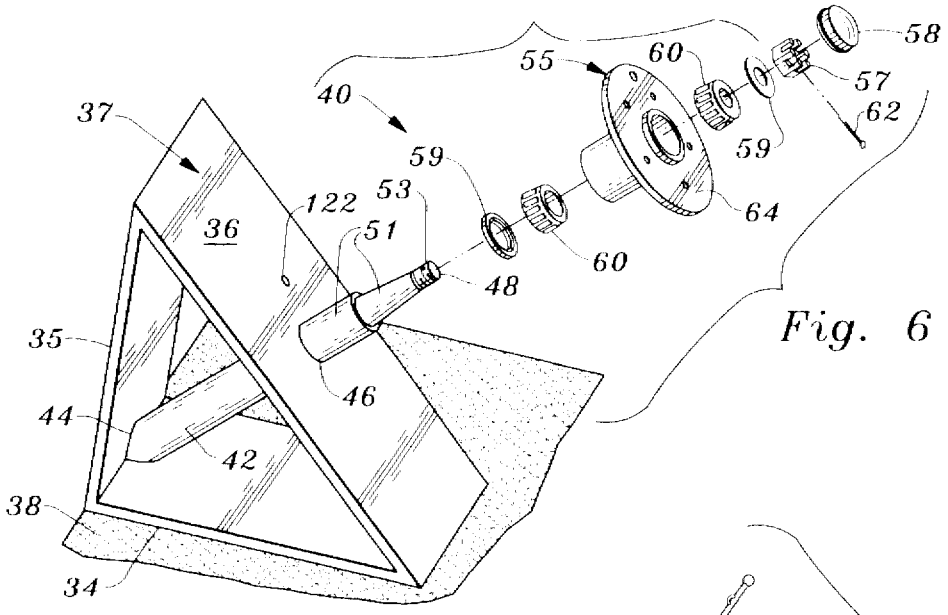
Fig. 6
Fig. 7
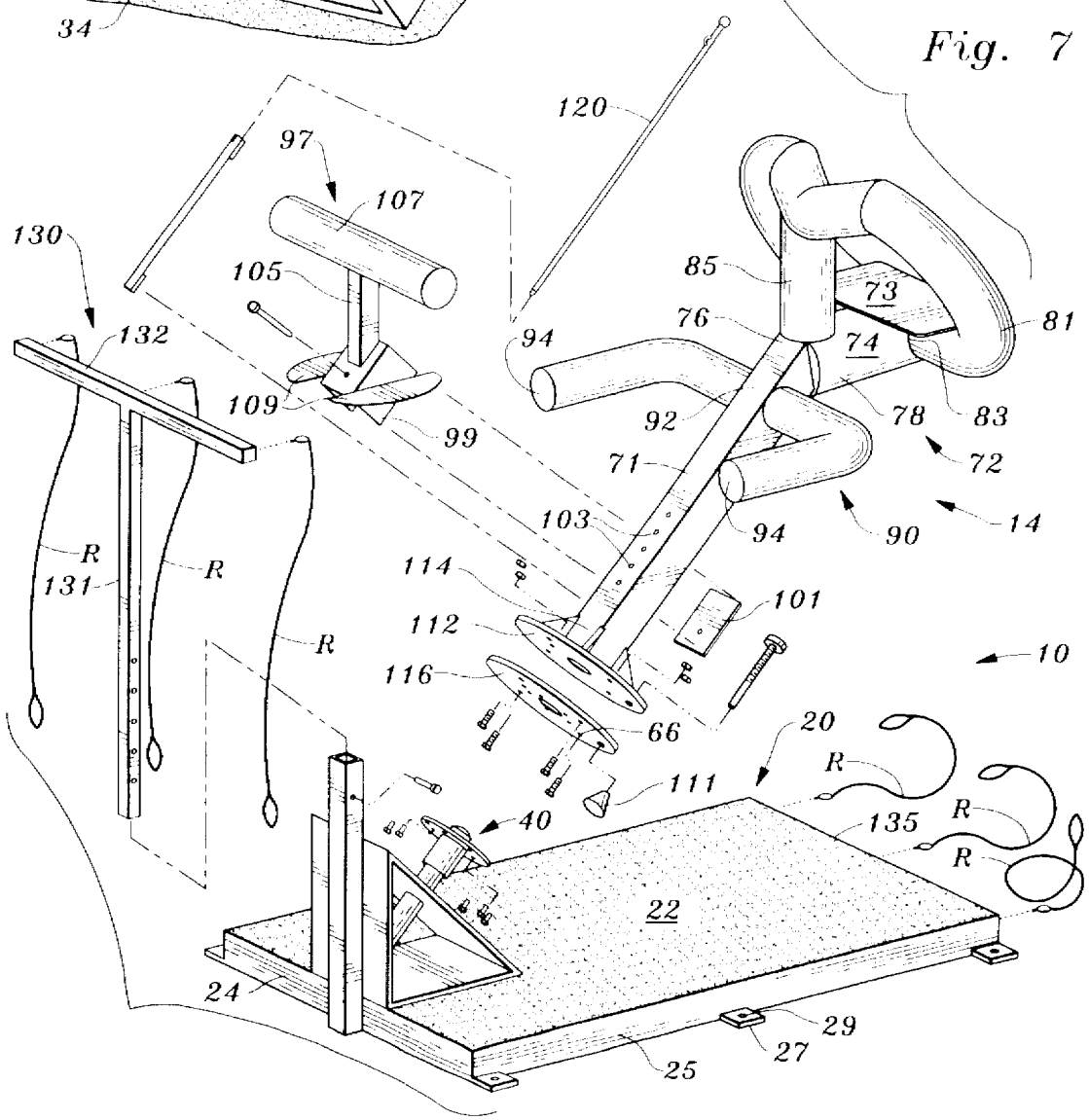

HIGH INTENSITY EXERCISE SYSTEM

The present invention relates generally to mechanical devices for use by individuals to exercise one or more muscle groups in order to develop stamina, bulk and/or flexibility, and, more specifically, to an exercise chair like device which provides a high intensity work out for several major muscle groups.

BACKGROUND OF THE INVENTION

Field of the Invention

There is currently a national fixation with fitness and, indeed, several businesses have blossomed and flourished, at least for a time, by pandering to the hopes and desires of many who wish to become physically fit and evoke an image of muscularity, without, of course, going to too much effort. The present invention does not fit into this mold and is not for those armchair athletes who dream of fitness while eating a bowl of popcorn.

The present invention has been created for the serious athlete who is focused on his or her particular fitness objective as a means to an end. The device of the present invention has particular appeal and application for the professional athlete, or the dedicated amateur who wishes to excel in a particular endeavor, such as, for example, the Olympics, and for whom overall fitness is a prerequisite to success.

Several well known companies, e.g., Nautilus® and Cybex®, to reference just two, have grown and prospered by developing mechanical contrivances for the working of one or more, but typically just one particular muscle group.

Still others such as LifeCycle® and NordicTrac® have concentrated on overall fitness concepts with various devices intended to elevate heart rates and provide aerobic exercise.

All of these devices can be found to a greater or lesser extent in models intended for home use and, of course, in commercial models for use in fitness centers, training facilities, and rehabilitation centers. All of these devices serve a particular need and purpose and, in most instances, serve that purpose well. Absent from the commercial market is a single device that can provide overall fitness to the dedicated athlete whose physical fitness is a condition precedent to his or her performance and ultimate success.

Overview of the Prior Art

The present invention differs dramatically from exercise bikes, simulated cross country ski devices, treadmills, stair climbers, and the like, all of which have, as their primary focus, aerobic exercise, in several novel respects, including, but not limited to, structure and purpose.

A search discloses a dearth of relevant patent art. While there are some patents that disclose devices that give the appearance of similarity, they are found in a clearly non-analogous art, and primarily in entertainment devices. One such patent is that of Willard, Pat. No. 3,439,914 which comprises a carrousel that is moved by the use of shifting body weight. The shifting of body weight is one concept that is employed in the use of the device of the present invention.

Snarr Pat. No. 4,620,700 is denominated as an occupant propelled roundabout and, again, it is an amusement device. Similarly, Sutherland offers a powered teeter toter, which appears to be an amalgamation of several other amusement devices, with the addition of an outside source of power.

Hansen, in his Pat. No. 3,837,641, suggests that his amusement device can also provide exercise and it does, indeed, seem that it might have some limited value, perhaps to the arm of the user, as exercise. In fact, all of these amusement devices probably have some exercise value incident to their use since in each some nominal body movement is required. In terms of beneficial movement, however, none can realistically be attributed to these toys since it is clearly minimal and of short duration.

Finally, the patents to Lewis, No. 2,862,710; Keeling No. 2,920,889, and Stewart, No. 5,370,583, are all illustrative of the state of the amusement device art, for which no legitimate exercise purpose is attributed.

SUMMARY OF THE INVENTION

Having provided some overview of the environment within which the present invention has particular utility, it is a first objective of the present invention to place at the disposal of the dedicated and focused athlete a highly useful tool for the material enhancement of the athlete's strength and stamina of all major muscle groups in a single exercise routine, employing the singular device of the present invention.

Another objective of the present invention is to provide a simple, yet powerful, tool which permits the user to pit one muscle group against another with a resultant strengthening of each, while coincidently providing an aerobic workout for the vascular system.

A further objective, related to the foregoing, is to provide a single device, capable of rotational movement about a skewed axis, by use of changes in body position and weight redistribution, such that the various muscle groups are extensively worked, while elevating the body's heart rate to an aerobically beneficial level.

Yet another objective of the present invention is the provision of a single device which will supplant the necessity of acquiring a multitude of devices, each of which is designed to work a particular muscle group, thereby providing a facile alternative to the high cost and space requirements incident the provision of an entire workout facility. Further, the device of the present invention can provide a complete work out in a short period of time on a single device.

These and other objectives and benefits will occur to one skilled in the art from a reading of the detailed description of a preferred embodiment, taken in conjunction with the drawings, wherein:

IN THE DRAWINGS

FIG. 6 is an exploded view of a stem shaft which supports the body of the device for relative rotation; and, FIG. 7 is an assembly drawing of the main body section of the device of FIG. 1, constructed in accordance with the present invention.

DETAILED DESCRIPTION OF A PREFERRED EMBODIMENT

Figure 1:
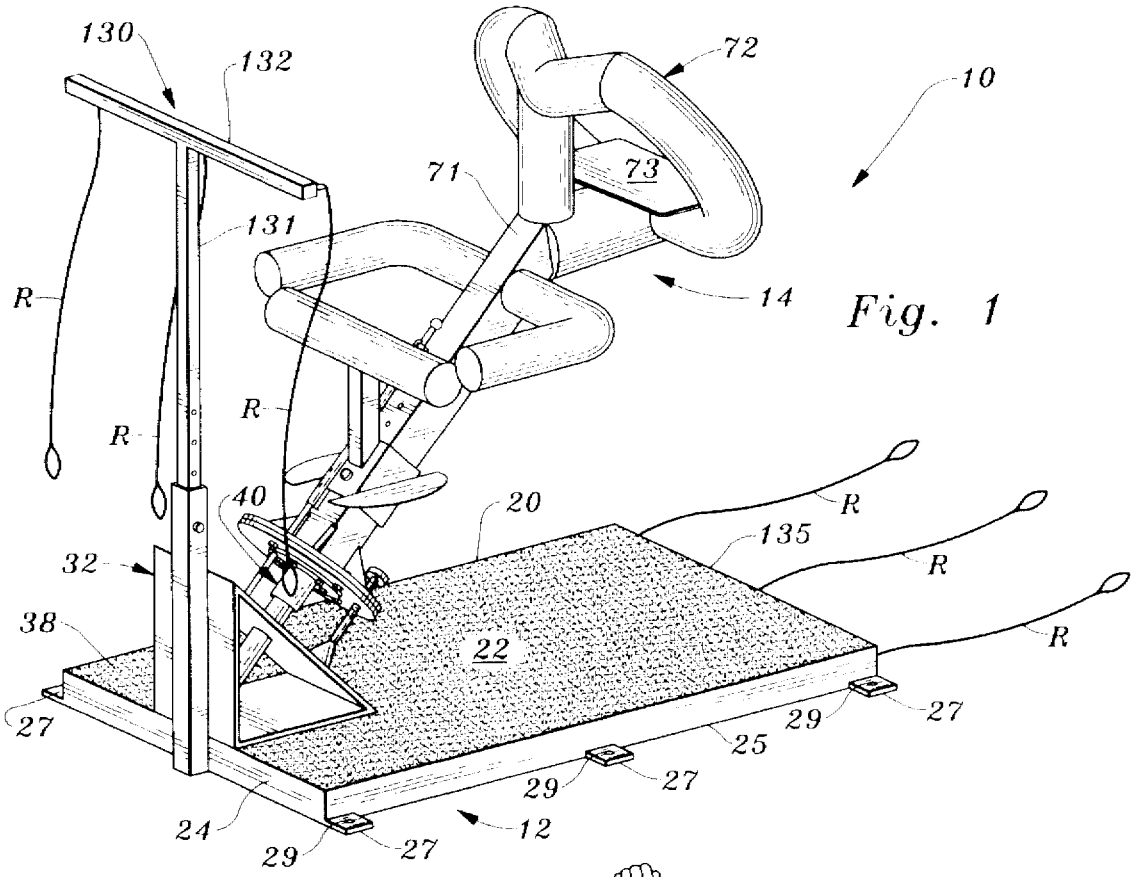
FIG. 1 is a perspective drawing of a device constructed in accordance with the present invention.

With reference now to the drawings, and initially to FIG. 1, a high intensity exercise device constructed in accordance with the present invention is illustrated at 10. The exercise device 10 comprises a base section, denominated generally at 12, and a chair section denominated generally at 14. It is a significant feature of the present invention that the chair section 14 is rotatable relative to the base section 12. By virtue of the ability of the chair to be rotated, exceptional balance is required to limit rotation. Accordingly, the user is challenged to exert large amounts of energy in avoidance or rotation, thereby greatly enhancing the exercise program which is expressly developed to take maximum advantage of the capabilities of the device.

With reference primarily to FIGS. 1 and 7, the base section comprises a relatively horizontal platform 20. The platform 20 is preferably constructed of heavy steel material with the flat upper face 22 being roughened, or otherwise constructed, to present a non slip surface to the user. Side walls 24 and 25 depend from the upper face 22.

A series of tangs, or feet, 27 are formed with, or otherwise affixed to, the side walls. The feet 27 extend outwardly and are coplaner with, or at least in a plane parallel to, the upper face 22.

Each foot 27 is drilled, or otherwise provided with an opening or hole 29, through which a fastener, of any well known variety (not illustrated), may be fitted to attach the base section 12 to a fixed surface. In this manner, great stability is provided for the device, even when being used by a very large and/or heavy user.

In order to position and secure the chair section 14 relative to the base section 12, the base section is fitted with a mounting bracket 32, which, as illustrated, comprises a series of very strong plates 34, 35, and 36, which, as best seen in FIG. 6, are interlocked, such as by welding, or other suitable means to define, in profile (see FIGS. 2, 3 and 4) to define a right triangle.

The mounting bracket 32 is affixed to the platform 20 at one end thereof, such as at 38 and this may be accomplished by welding, or if portability is important, by a series of fasteners, without departure from the invention.

It is another feature of the device 10 of the present invention that the chair section 14 is supported on the base section at an acute angle $\alpha$ relative to the platform 20. The mounting is such that the angle $\alpha$ may be varied without departure from the invention, by moving it in a vertical plane, preferably between 30 and 60 degrees. It will be appreciated that should the angle be less than 30° the amount of support the base section must deliver, particularly for a large and heavy user, is significantly increased.

In a similar manner, if the chair section were more upright than 60°, the level of exertion necessary to perform the exercises which are indigenous to the device 10 is materially decreased to the extent that the intrinsic value of the device, as a high intensity, serious exercise device, is compromised.

In any event, in order to support the chair section 14 at an appropriate angle $\alpha$, a post assembly includes a stem shaft 40, best illustrated in FIG. 6, includes a spindle 42, having one end 44 affixed at the intersection of plates 34 and 35. It will be appreciated that the post assembly may be hinged, as distinguished from rigidly affixed, in order that the spindle may be moved in a vertical plane through a range of predetermined angles, such as between 30 and 60 degrees.

Similarly, the spindle is supported in a hole 46 formed in the plate 36. However, that hole 46 could be a slot, in keeping with this aspect of the invention, in order that movement of the spindle could be readily achieved.

Again referring primarily to FIG. 6, the free end 48 of the spindle 42 is tapered as at 51 and terminates in a threaded section 53. In keeping with the concept of relative rotation of the chair section 14 relative to the base, a flanged collar 55 is secured for relative rotation to the spindle 42, by means of a cap nut 57, or other suitable fastener. Thrust washers 59 and roller bearings 60 are provided, as seen in FIG. 6, and a lock washer 62 holds the bearing assemblage in place.

For purposes of securing the chair section 14, for relative rotation with the base section 12, a flange 64, is provided in a plane transverse to the longitudinal axis of the flanged collar 55. The flange has several fastener receiving holes 66 in a circular pattern about the flange.

The chair section of the exercise device 10 is anchored, at the free end of an elongated post or pillar 71. While the post is depicted as being constructed of rectangular tubing, circular or other configurations may be employed without departure from the invention, since the principal concern is one of sufficient strength to support an active user in a cantilevered position, as seen in FIGS. 2 through 5.

Figure 2:
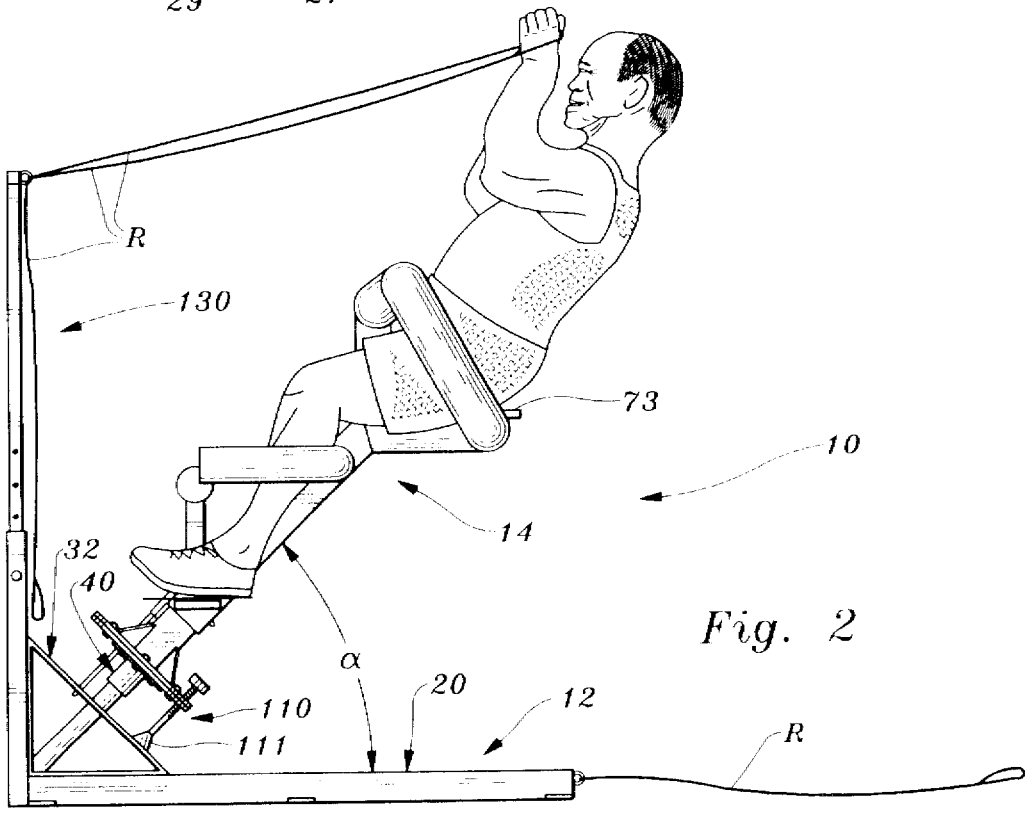
FIG. 2 is a side elevation of the novel device of FIG. 1, and further illustrating the position a user would assume as part of an exercise routine using the device.

The chair section 14 is, in accordance with the invention, constructed to accommodate a user in an essentially seated position. To this end, and with reference to FIG. 7, a saddle 72 is provided and comprises a straddle bar 74, which is affixed to the post 71 at the free end 76 thereof. A seat 73, best seen in FIGS. 1 and 2, is preferably removably affixed to the saddle in any well known manner, in order to provide a relatively flat surface against which the user may apply leverage by means of his or her gluteus maximus muscle group.

The straddle bar 74 extends rearwardly, in a ls, lane which is essentially parallel to the platform 22, although some angularity may be experienced in adjusting the angle of the post 71 through its preferred range. The straddle bar is heavily padded, as at 78, so as to inhibit possible injury to the user.

In order to encircle the user about the lower abdominal area, a padded ring 81 is attached to the free end 83 of the straddle bar 74. In order to assure suitable rigidity, a center post 85 is interposed between and secured to the ring 81 and the free end 76 of the post 71.

A user of the device 10, of the present invention accomplishes the objectives of the device by using several structural elements of the device as reactive members. This is accomplished, generally, by engaging such structural elements by certain body parts, and pushing or pulling against such elements, which are relatively rigid, while at the same time exercising specific muscle groups. In order to facilitate this interaction, a clevis shaped reactive member is secured to the post 71 at an appropriate position below the free end 76 thereof. As in the case of previous reactive members, the clevis 90 is heavily padded to avoid injury, chafing and the like during use. The clevis 90 is attached at its center point 92 to the post 71, and terminates at the opposed ends 94.

It is intended that the clevis 90 be so positioned as to embrace the user at about the knees thereof in order that the thighs, knees and calves may selectively engage the clevis during exercise.

Since at least some of the exercise routines available to the user require that the feet be used, the invention provides foot support 97. As seen in FIG. 7, the foot support includes a positioning bracket 99 which is intended to encircle the post 71, and a cap 101 which closes the bracket 99 around the post to position it in one of the positioning holes 103 formed in the post 71.

Upstanding on the bracket 99 is a vertical post 105, which terminates in a padded T bar 107. The bracket 99 is flanked by foot pads 109. In use, once the foot support is adjusted for the height and comfort of the user, the T bar occupies the space between the ends 94 of the clevis 90, in order to define, together, a closed loop against which the user may apply pressure with various muscles in accomplishing defined exercise routines.

The chair section 14 is secured to the base section 12 for rotation about the axis of the post 71. To this end, plate 112 is secured at the base 114 of the post 71, which in turn fastens to intermediate connector plate 116. The plate 116 is connected by suitable fasteners to the thrust collar 55, thereby completing the requisite connection.

It is contemplated that even the most dedicated and accomplished athlete may, at some point, find that he or she wants to stop rotation of the chair section 14 and, of course, in order to mount and dismount the device 10, it is desirable that rotation be inhibited. This can be accomplished manually, in keeping with this aspect of the invention, by means of a lock rod 120, seen in FIG. 7, which is slidably mounted to the post 71, in any suitable fashion, and aligned with hole 122 in the plate 36. By dropping the rod onto the plate 36, when the rod 120 comes around, it will drop into the hole 122 to stop the chair's rotation, or to hold the chair against rotation, while at rest.

A braking system, as a redundant safety system, is also contemplated by the invention and, in a rudimentary form, may comprise a simple plunger assembly 110, which is easily reachable by the user, and which selectively presents a braking pad 111 to the surface of the plate 36, causing frictional engagement therewith to inhibit rotation.

As an alternative, a simple disc braking system, of well known construction, is readily interposed between the plates 112 and 116 without departure from the invention. The brake is readily linked to one of the foot pads 109 to permit inhibition of rotation of the chair section 14 by foot pressure, which is a familiar conditioned reaction similar to that used in driving a car.

With particular reference now to FIGS. 2 through 5, a user is shown in various configurations that one would assume in following an exercise routine for the device of the present invention.

The routine is premised on the concept of selectively placing pressure on various parts of the device, e.g., the foot supports, saddle, clevis, and the like, with the users knees, feet, thighs and waist area, in a preset sequence. The application of such selective pressure acts as a pressure point, or fulcrum, against which other parts of the body work as they perform various maneuvers. Movement of the upper body, which is essentially free of the device, will work with and against gravity to tension various muscle groups. Blood will feed the muscle groups under tension, thereby strengthening them. Coincidently, the body will increase its use of nutrients, creating an aerobic environment which enhances the body's ability to convert sugars and fats to energy.

Figure 5:
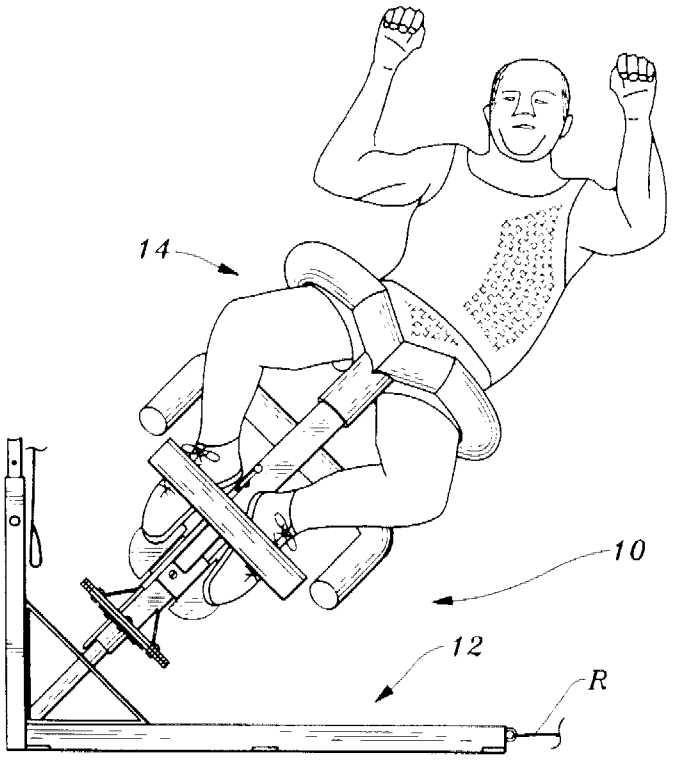
FIGS. 3, 4 and 5, are illustrations similar to that of FIG. 2, depicting the position assumed by a user in the performance of various exercises for which the device of the present invention is uniquely capable.

By way of example, in FIG. 5 the user has feet pressed against the T bar 107 and his upper thighs pressed against the ring 81. By moving his upper body, tension is created in selected muscle groups, thereby stimulating oxygenation and growth in those muscles under tension.

Figure 4:
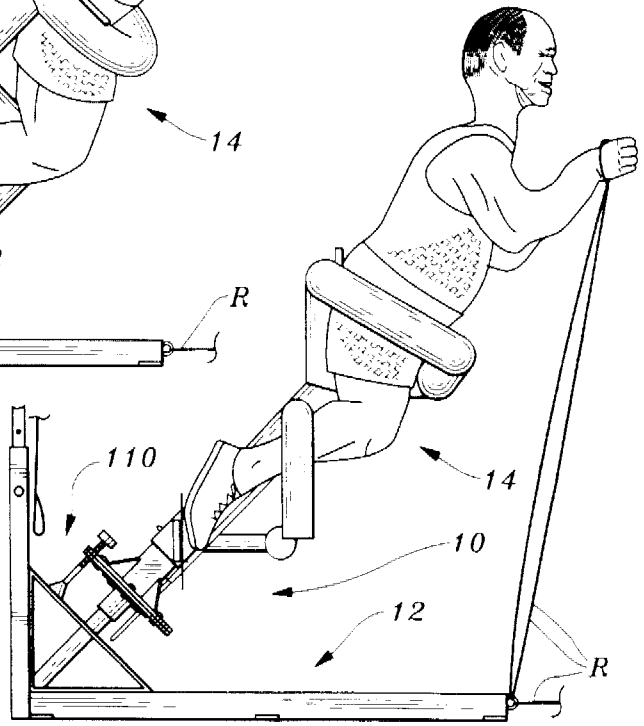
Figure 3:
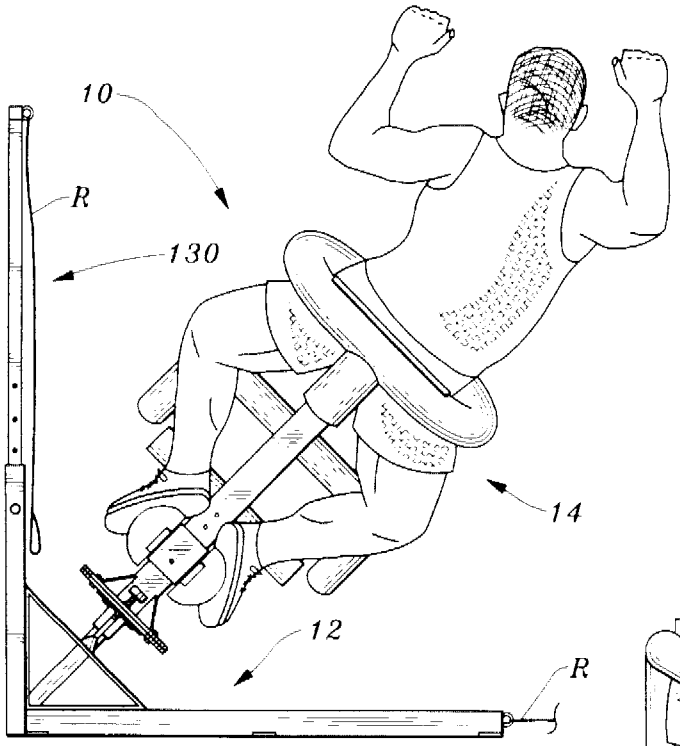

In FIG. 4, the calves of the user press against the clevis 90, and in FIG. 3, the knees are used for the same purpose. These illustrations are by way of example only, and the user will discover an infinite number of positions within the scope of the invention.

As an adjunct to the workout regime, cords, or ropes, R are provided to permit the application of upper body resistance. To this end, a T shaped bar arrangement 130, having an upstanding post 131, terminates in a cross bar 132. The ropes R are strategically attached to the cross bar 132 well within reach of the user. In a similar fashion, ropes R are attached at the rear end 135 of the platform 20, and are also well within reach of the user. By grasping these ropes R, the user can create upper body tension in several positions, thereby increasing the intensity of his or her workout and its intrinsic value to the user.

It will be appreciated that all of the areas of contact with the user's body may be padded to avoid injury or soreness and that these areas may be upholstered, or formed, or molded with padding material without departure from the invention.

The intensity of the workout can likewise be increased by the use of any one or several of well known props such as dumbbells, bags and other weighted objects that may be grasped in the hands and arms during workouts to enhance such workouts in the upper body regions of arms, for example. The user may do several sets of exercises with the dumbbells while in a tensioning position, thus working the biceps and triceps, while simultaneously working major muscle groups.

Having thus described a preferred embodiment of the invention,

What is claimed is:

1. A high intensity exercise device comprising, in combination:

a chair; a base member; a post assembly, said post assembly having one end thereof mounted to said base member for relative rotation thereto;

said chair being rigidly secured to said post; said chair including a saddle, means defining a ring about the saddle, and rigidly secured thereto, said ring be positioned to encircle the waist area of a user of the exercise device;

means defining a clevis, said clevis being secured to said post at a position beneath said saddle, said clevis adapted to partially encircle the knee and thigh area of a user of the exercise device; and a foot support, said foot support being mounted to said post, and selectively movable relative thereto along a path which is parallel with the axis of said post, whereby a user disposed on said saddle may apply pressure to said chair with selected parts of his body to perform high intensity exercises.

2. The exercise device of claim 1, wherein a seat is removably affixed to said saddle.

3. The exercise device of claim 1, wherein locking means is provided for preventing relative rotation of said post relative to said base.

4. The exercise device of claim 1, wherein brake means is provided between said base and said post, said brake means being manually actuated to inhibit relative movement between said post and said base.

5. The exercise device of claim 2, wherein locking means is provided for preventing relative rotation of said post relative to said base.

6. The exercise device of claim 2, wherein brake means is provided between said base and said post, said brake means being manually actuated to inhibit relative movement between said post and said base.

7. The exercise device of claim 1, wherein the position of said foot support is changeable along said post.

8. The exercise device of claim 1, wherein said post assembly includes a spindle, said spindle being affixed at one end thereof, a post, said post have an end opposite said saddle, said end having a plate secured thereto, bearing means on said spindle, a thrust collar disposed on said bearing means, and said thrust collar and said plate being attached to form said post assembly wherein said post is rotatable relative to said base.

9. A high intensity exercise device comprising, in combination:

a padded chair, said chair including a removable seat; a base member; a post assembly, said post assembly having one end thereof mounted to said base member for limited movement in a vertical plane;

said post assembly being disposed at an acute angle relative to said base member, and said padded chair being rotatable relative to said base member;

said padded chair being rigidly secured to said post assembly at an end thereof opposite the end mounted to said base member; said chair including a saddle, means defining a ring about the saddle, and rigidly secured thereto, said ring being positioned to encircle the waist area of a user of the exercise device; said saddle and said ring being padded;

means defining a clevis, said clevis being secured to said post at a position beneath said saddle, said clevis being padded, and adapted to partially encircle the knee and thigh area of a user of the exercise device;

and a foot support, said foot support being mounted to said post, and selectively movable relative thereto along a path which is parallel with the axis of said post, whereby a user disposed on said saddle may apply pressure to said chair with selected parts of his body to perform high intensity exercises.

10. The exercise device of claim 9, wherein said acute angle can be set between 30° and 60°.

11. The exercise device of claim 9, wherein said acute angle is 45°.

12. The exercise device of claim 9, wherein said foot support includes an upstanding post; said post having a T bar at the top thereof, whereby said foot support is adjustable to place said T bar in a position adjacent the user's knees to permit the user to selectively apply pressure thereto with one or both of his or her knees during exercise.

13. The exercise device of claim 9, wherein said post assembly includes a spindle, said spindle being affixed at one end thereof, a post, said post having an end opposite said saddle, said end having a plate secured thereto, bearing means on said spindle, a thrust collar disposed on said bearing means, and said thrust collar and said plate being attached to form said post assembly wherein said post is rotatable relative to said base.

14. The exercise device of claim 10, wherein said post assembly includes a spindle, said spindle being affixed at one end thereof, a post, said post having an end opposite said saddle, said end having a plate secured thereto, bearing means on said spindle, a thrust collar disposed on said bearing means, and said thrust collar and said plate being attached to form said post assembly wherein said post is rotatable relative to said base.

15. The exercise device of claim 10, wherein said foot support includes an upstanding post; said post having a T bar at the top thereof, whereby said foot support is adjustable to place said T bar in a position adjacent the user's knees to permit the user to selectively apply pressure thereto with one or both of his or her knees during exercise.

16. The exercise device of claim 9, wherein brake means is provided between said base and said post, said brake means being manually actuated to inhibit relative movement between said post and said base.

17. The exercise device of claim 9, wherein locking means is provided for preventing relative rotation of said post relative to said base.

18. The exercise device of claim 15, wherein locking means is provided for preventing relative rotation of said post relative to said base.

19. The exercise device of claim 1, including a series of ropes, said ropes being mounted to said base for use during an exercise program.

20. The exercise device of claim 9, including a series of ropes, said ropes being mounted to said base for use during an exercise program.

* * * * *